US007604266B2

(12) United States Patent
Ellis

(10) Patent No.: US 7,604,266 B2
(45) Date of Patent: Oct. 20, 2009

(54) SPINDLE ASSEMBLY FOR USE IN A DOOR HANDLE ASSEMBLY

(75) Inventor: Philip C. Ellis, Sinking Spring, PA (US)

(73) Assignee: Newfrey, LLC, Newark, DE (US)

( * ) Notice: Subject to any disclaimer, the term of this patent is extended or adjusted under 35 U.S.C. 154(b) by 193 days.

(21) Appl. No.: 11/099,079

(22) Filed: Apr. 5, 2005

(65) Prior Publication Data

US 2006/0220396 A1 Oct. 5, 2006

(51) Int. Cl.
*E05B 3/00* (2006.01)

(52) U.S. Cl. ..... 292/336.3; 292/336.5; 292/358

(58) Field of Classification Search ..... 292/336.3, 292/336.5, 356, 358, 359
See application file for complete search history.

(56) References Cited

U.S. PATENT DOCUMENTS 2,827,323 A * 3/1958 Kessel et al. ..... 292/352
4,899,561 A * 2/1990 Myers ..... 70/208
5,505,508 A * 4/1996 Kuo ..... 292/359
5,598,726 A * 2/1997 Cordle ..... 70/224
5,608,298 A * 3/1997 Frolov et al. ..... 318/286
5,617,749 A * 4/1997 Park ..... 70/224
5,934,117 A * 8/1999 Shen ..... 70/224
5,941,108 A * 8/1999 Shen ..... 70/467
6,141,998 A * 11/2000 Seo ..... 70/224
6,616,203 B1 * 9/2003 Lenk et al. ..... 292/336.3
7,077,437 B2 * 7/2006 Huang ..... 292/336.3
7,178,373 B2 * 2/2007 Shen et al. ..... 70/224

* cited by examiner

*Primary Examiner*—Peter M. Cuomo
*Assistant Examiner*—Mark Williams
(74) *Attorney, Agent, or Firm*—Richard J. Veltman, Esq.; Taylor & Aust, P.C.; Ronald K. Aust, Esq.

(57) ABSTRACT

A door handle assembly includes a door handle having an operator portion, and a shank extending from the operator portion, the shank having a first opening. A door latch mechanism has a rotatable actuator, the rotatable actuator having a second opening. A spindle assembly includes a spindle and a spring. The spindle has a first end and a second end. The spring is attached to the first end of the spindle. The spring and the first end of the spindle of the spindle assembly are inserted as a unit into the first opening of the shank of the door handle, and the second end of the spindle is inserted into the second opening of the rotatable actuator of the door latch mechanism.

8 Claims, 3 Drawing Sheets

SPINDLE ASSEMBLY FOR USE IN A DOOR HANDLE ASSEMBLY

BACKGROUND OF THE INVENTION

1. Field of the Invention

The present invention relates to a door handle assembly, and, more particularly, to a spindle assembly for use in a door handle assembly.

2. Description of the Related Art

Door handle assemblies have long been available that include a door handle, e.g., knob or lever, that is rotatably supported by an escutcheon, and retained thereto using a fastener, such as a snap ring. The door handle includes, for example, an operator portion and a shank. Included in the door handle assembly is a coupling, which may include two or more loose parts, that connects the door handle shank to a door latch mechanism. Such an arrangement, however, may be difficult to assemble due to the multiple loose parts.

What is needed in the art is a design that reduces the number of loose parts needed to assemble the door handle assembly.

SUMMARY OF THE INVENTION

The present invention provides a design that reduces the number of loose parts needed to assemble the door handle assembly.

The invention, in one exemplary embodiment, is directed to a door handle assembly. The door handle assembly includes a door handle having an operator portion, and a shank extending from the operator portion, the shank having a first opening. A door latch mechanism has a rotatable actuator, the rotatable actuator having a second opening. A spindle assembly includes a spindle and a spring. The spindle has a first end and a second end. The spring is attached to the first end of the spindle. The spring and the first end of the spindle of the spindle assembly are inserted as a unit into the first opening of the shank of the door handle, and the second end of the spindle is inserted into the second opening of the rotatable actuator of the door latch mechanism.

The invention, in another exemplary embodiment, is directed to a spindle assembly, including a spindle having a first end and a second end, and a spring attached to the first end of the spindle.

The invention, in another exemplary embodiment, is directed to a method of forming a spindle assembly, including providing a coil spring having a proximal end and a distal end, the proximal end of the coil spring having a normal inside diameter that is expandable to a second diameter; providing a spindle having a spindle body and a spindle post axially aligned with the spindle body along an axis, the post having a dimension perpendicularly intersecting the axis that is greater than the normal inside diameter of the spring; expanding the coil spring to the second diameter; inserting the post of the spindle into the proximal end of the coil spring; and releasing the coil spring from the second diameter to return toward the normal diameter to form a snug fit attachment of the coil spring to the post of the spindle.

The invention, in another exemplary embodiment, is directed to a method of assembling a door handle assembly, the door handle assembly including a door handle and a door latch mechanism, the door handle being rotatably coupled to a mounting plate, the door handle having an operator portion and a shank extending from the operator portion, the shank having a first opening, and the door latch mechanism having a rotatable actuator, the rotatable actuator having a second opening. The method includes forming a spindle assembly by attaching a spring to a spindle, the spindle having a first end and a second end, the spring being attached to the first end of the spindle; inserting the spring and the first end of the spindle into the first opening of the shank of the door handle; and inserting the second end of the spindle into the second opening of the rotatable actuator of the door latch mechanism.

In one embodiment, for example, an advantage of the invention is the reduction in the number of loose parts needed to assemble the door handle assembly, thereby making assembly easier.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
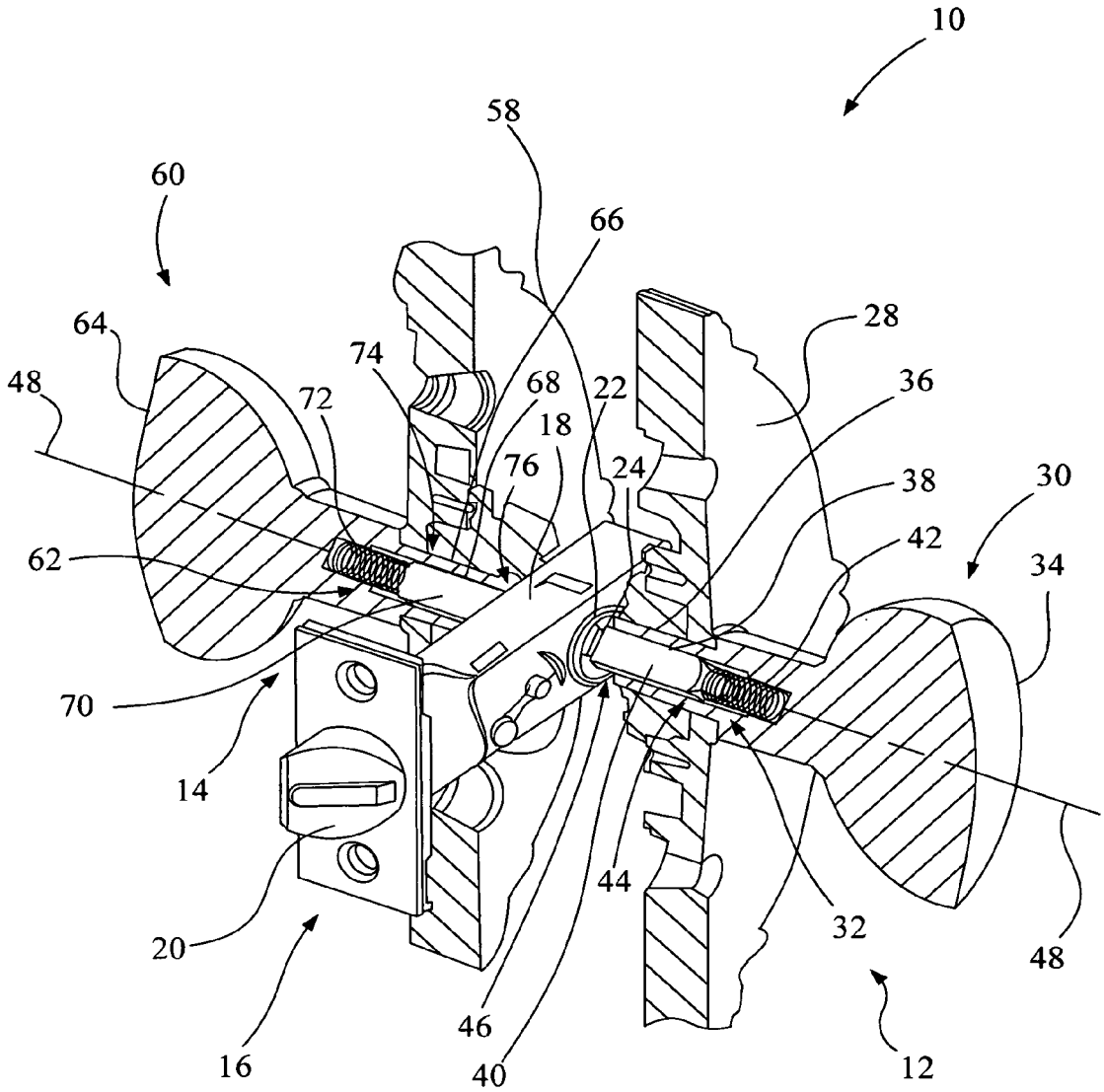
FIG. 1 is a sectioned perspective view of a door handle set embodying the present invention.

Referring now to the drawings, and more particularly to FIG. 1, there is shown a door handle set 10 including an interior door handle assembly 12, an exterior door handle assembly 14, and a door latch mechanism 16.

Door latch mechanism 16 includes a body 18, a latch bolt 20, and a rotatable actuator 22. Rotatable actuator 22 includes an opening 24. Door latch mechanism 16 is of a type commonly used in the art, and will not be further described herein.

Interior door handle assembly 12 includes an interior mounting plate 28, which may be in the form of an escutcheon, an interior door handle 30, and a spindle assembly 32. Interior door handle 30 is rotatably coupled to interior mounting plate 28. Interior door handle 30 includes an operator portion 34 and a shank 36 that extends from operator portion 34. Shank 36 includes an opening 38.

Spindle assembly 32 includes a spindle 40 and a spring 42. Spindle 40 has a first end 44 and a second end 46. Spring 42 is attached to first end 44 of spindle 40. Spring 42 and first end 44 of spindle 40 of spindle assembly 32 are inserted, as a unit, into opening 38 of shank 36 of interior door handle 30. Second end 46 of spindle 40 is inserted into the opening 24 of rotatable actuator 22 of door latch mechanism 16. An axis 48 serves as a rotational axis for interior door handle 30 with respect to interior mounting plate 28, as well as serving as the axis that passes longitudinally through the center of spindle 40.

Exterior door handle assembly 14 includes an exterior mounting plate 58, which may be in the form of an escutcheon, an exterior door handle 60, and a spindle assembly 62. Exterior door handle 60 is rotatably coupled to exterior mounting plate 58. Exterior door handle 60 includes an operator portion 64 and a shank 66 that extends from operator portion 64. Shank 66 includes an opening 68.

Spindle assembly 62 includes a spindle 70 and a spring 72. Spindle 70 has a first end 74 and a second end 76. Spring 72 is attached to first end 74 of spindle 70. Spring 72 and first end 74 of spindle 70 of spindle assembly 62 are inserted, as a unit, into opening 68 of shank 66 of exterior door handle 60. Second end 76 of spindle 70 is inserted into the opening 24 of rotatable actuator 22 of door latch mechanism 16. Axis 48 serves as a rotational axis for exterior door handle 60 with respect to exterior mounting plate 58, as well as serving as the axis that passes longitudinally through the center of spindle 70.

In the present embodiment, spindle assembly 32 and spindle assembly 62 are substantially identical, such that a detailed description of one will also apply to the other. Accordingly, for brevity, the details of the construction of spindle assemblies 32, 62 will be described below with respect only to spindle assembly 32.

Figure 2A:
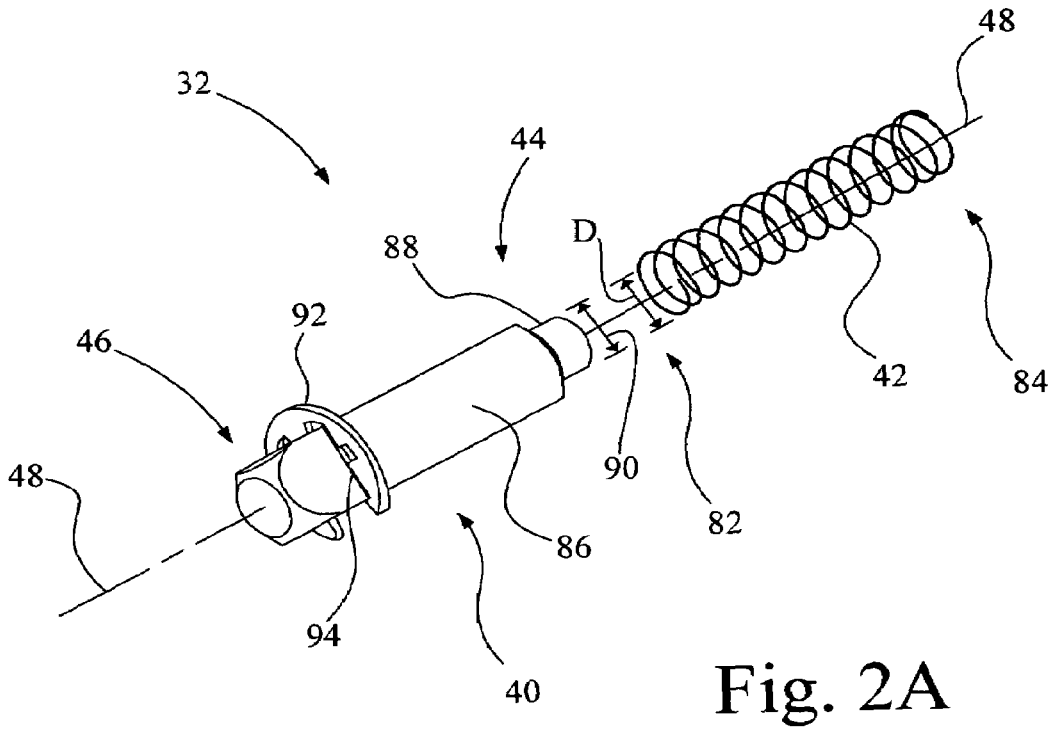
FIG. 2A is a partially exploded perspective view of a spindle assembly in accordance with the present invention.
Figure 2B:
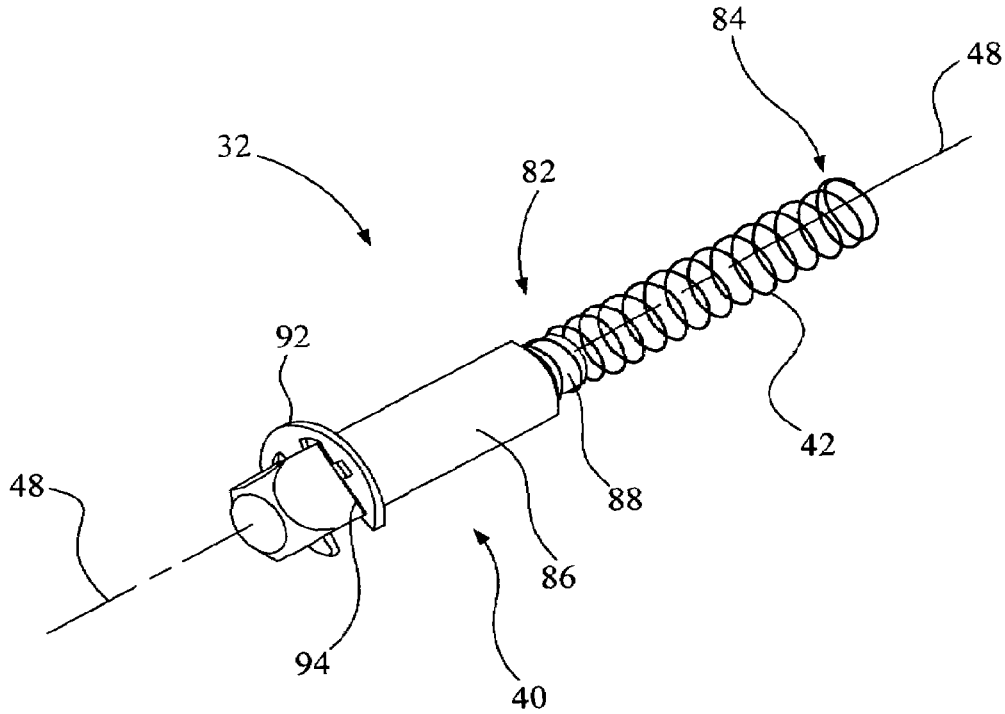
FIG. 2B is a perspective view of the spindle assembly of FIG. 2A in an assembled state.

Referring now to FIGS. 2A and 2B, in the illustrated embodiment, spring 42 is a coil spring having a proximal end 82 and a distal end 84. Proximal end 82 of coil spring 42 has a diameter D that may be varied, for example, between a normal inside diameter, i.e., when spring 42 is at rest, and an expanded second diameter. The expanded second diameter of coil spring 42 may be achieved, for example, by applying a rotation to distal end 84 in a direction counter to the coil rotation of coil spring 42 while holding proximal end 82 stationary.

Spindle 40 includes a spindle body 86 and a spindle post 88 axially aligned with said spindle body along axis 48. Spindle post 88 has a dimension 90 perpendicularly intersecting axis 48 that is greater than the normal inside diameter of coil spring 42.

As shown in FIG. 2B, spindle post 88 is inserted into proximal end 82 of coil spring 42 and together form a snug fit attachment of coil spring 42 to spindle 40. More particularly, coil spring 42 is expanded to an expanded diameter larger than the normal diameter, spindle post 88 of spindle 40 is inserted into proximal end 82 of coil spring 42, and coil spring 42 is released from the expanded diameter to return toward the normal diameter to form a snug fit attachment of coil spring 42 to spindle post 88 of spindle 40.

Spindle 40 has attached thereto a limiter 92. Limiter 92 may be attached to spindle 40, for example, near second end 46 of spindle 40 to limit an extent that second end 46 of spindle 40 is inserted into the opening 24 of rotatable actuator 22 of door latch mechanism 16. In the embodiment shown in FIGS. 2A and 2B, for example, limiter 92 may be in the form of a C-clip. Spindle post 88 of spindle 40 may further include a groove 94 for receiving the C-clip. Those skilled in the art will recognize that limiter 92 may take on any form capable of limiting the extent that spindle 40 is permitted to enter opening 24 of rotatable actuator 22 of door latch mechanism 16, and may be formed integral with spindle 40. Other forms of limiter 92 may include, for example, a flange, a pin, a set screw, a weld bump, etc.

Figure 3:
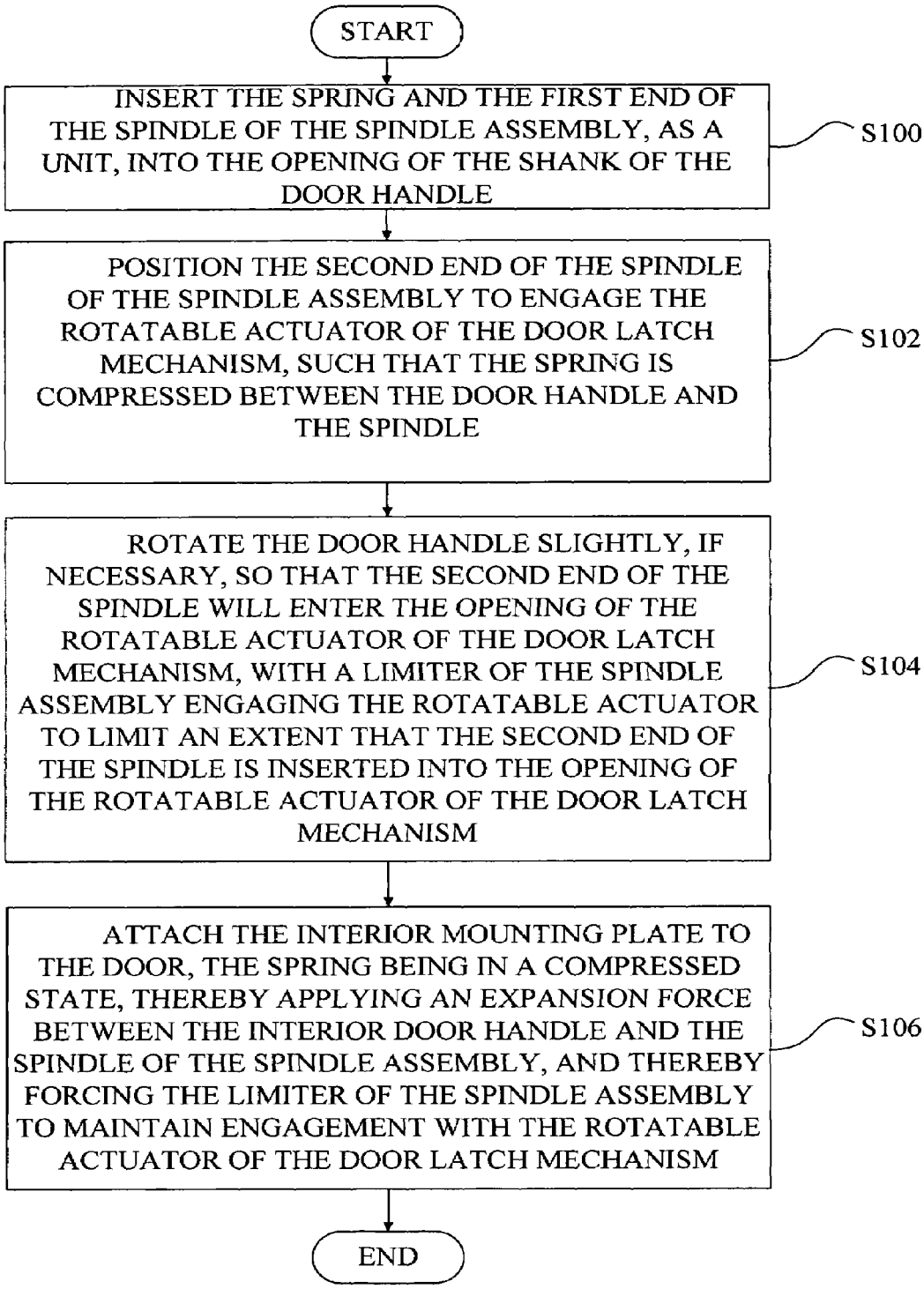
FIG. 3 is a flowchart of general steps for assembling a door handle assembly.

FIG. 3 is a flowchart of the general steps for assembling a door handle assembly, such as interior door handle assembly 12, and the attachment of the door handle assembly to a door. The steps described below with respect to interior door handle assembly 12 may be easily adapted for use with exterior door handle assembly 14, and thus for brevity will not be separately described for exterior door handle assembly 14.

At step S100, spring 42 and first end 44 of spindle 40 of spindle assembly 32 are inserted as a unit into opening 38 of shank 36 of interior door handle 30. The cross-sectional shapes of each of opening 38 in shank 36 and first end 44 of spindle 40 are selected to permit slidable engagement of spindle 40 with interior door handle 30 in a direction along axis 48, while drivably coupling interior door handle 30 to spindle 40 for common, non-independent, rotation around axis 48. For example, the cross-sectional shapes of first end 44 of spindle 40 and opening 38 of shank 36 of interior door handle 30 may be polygonal, such as square.

At step S102, second end 46 of spindle 40 of spindle assembly 32 is positioned to engage rotatable actuator 22 of door latch mechanism 16, such that spring 42 is compressed between interior door handle 30 and spindle 40.

At step S104, interior door handle 30 is rotated slightly, if necessary, so that second end 46 of spindle 40 will enter opening 24 of rotatable actuator 22 of door latch mechanism 16. The cross-sectional shapes of each of opening 24 of rotatable actuator 22 of door latch mechanism 16 and second end 46 of spindle 40 are selected to permit slidable engagement of spindle 40 with opening 24 of rotatable actuator 22 of door latch mechanism 16 in a direction along axis 48, while drivably coupling rotatable actuator 22 of door latch mechanism 16 to spindle 40 for common, non-independent, rotation around axis 48. For example, the cross-sectional shapes of second end 46 of spindle 40 and opening 24 of rotatable actuator 22 of door latch mechanism 16 may be polygonal, such as square.

Limiter 92 of spindle assembly 32 will engage rotatable actuator 22 to limit an extent that second end 46 of spindle 40 is inserted into opening 24 of rotatable actuator 22 of door latch mechanism 16.

At step S106, interior mounting plate 28 is attached to the door. Spring 42, being in a compressed state, applies an expansion force between interior door handle 30 and spindle 40 of spindle assembly 32, thereby forcing limiter 92 of spindle assembly 32 to maintain engagement with rotatable actuator 22, whereby limiting internal free play within interior door handle assembly 12 and reducing noise.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A door handle assembly, comprising:

a door handle having an operator portion, and a shank extending from said operator portion, said shank having a first opening;

a door latch mechanism having a rotatable actuator, said rotatable actuator having a second opening; and a spindle assembly including a spindle and a coil spring, said spindle having a first end and a second end, said coil spring having a normal inside diameter that is expandable to a second diameter, said first end of said spindle having a cross sectional diameter that is greater than said normal inside diameter of said spring, said coil spring being attached to said first end of said spindle by inserting said first end of said spindle into said coil spring when at said second diameter and permitting said coil spring to release back toward said first diameter to form a snug fit of said coil spring to said first end of said spindle, wherein said coil spring and said first end of said spindle of said spindle assembly are inserted as a unit into said first opening of said shank of said door handle, and said second end of said spindle is inserted into said second opening of said rotatable actuator of said door latch mechanism.

2. A door handle assembly, comprising:

a door handle having an operator portion, and a shank extending from said operator portion, said shank having a first opening;

a door latch mechanism having a rotatable actuator, said rotatable actuator having a second opening; and a spindle assembly including a spindle, a coil spring and a limiter, said spindle having a first end and a second end, said coil spring being attached to said first end of said spindle in a snug fit attachment wherein said coil spring is expanded from a normal diameter to an expanded diameter, said first end of said spindle is inserted into the expanded coil spring, and said coil spring is released from said expanded diameter to return toward said normal diameter, wherein said coil spring and said first end of said spindle of said spindle assembly are inserted as a unit into said first opening of said shank of said door handle, and said second end of said spindle is inserted into said second opening of said rotatable actuator of said door latch mechanism; and said limiter forming a part of said spindle assembly being attached to said spindle near said second end of said spindle to limit an extent that said second end of said spindle is inserted into said second opening of said rotatable actuator of said door latch mechanism.

3. The door handle assembly of claim 2, wherein said limiter is a C-clip that engages a groove in said spindle.

4. A door handle assembly, comprising:

a door handle having an operator portion, and a shank extending from said operator portion, said shank having a first opening;

a door latch mechanism having a rotatable actuator, said rotatable actuator having a second opening; and a spindle assembly including a spindle and a spring, said spindle having a first end and a second end, said spring being attached to said first end of said spindle, wherein said spring and said first end of said spindle of said spindle assembly are inserted as a unit into said first opening of said shank of said door handle, and said second end of said spindle is inserted into said second opening of said rotatable actuator of said door latch mechanism, wherein:

said spring is a coil spring having a proximal end and a distal end, said proximal end of said coil spring having a normal inside diameter that is expandable to a second diameter;

said spindle includes a spindle body and a spindle post axially aligned with said spindle body along an axis, said spindle post having a dimension perpendicularly intersecting said axis, said dimension is greater than said normal inside diameter of said spring; and said spindle post of said spindle is inserted into said proximal end of said coil spring to form a snug fit attachment of said coil spring to said spindle.

5. A spindle assembly for a door handle assembly, comprising:

a spindle having a first end and a second end; and a coil spring having a normal diameter and an expanded diameter, said spring being attached to said first end of said spindle by a snug fit of said spring to said first end of said spindle wherein said coil spring is expanded from said normal diameter to said expanded diameter, said first end of said spindle is inserted into the expanded coil spring, and said coil spring is released from said expanded diameter to return toward said normal diameter wherein said coil spring and said first end of said spindle of said spindle assembly are insertable as a unit into a first opening of a shank of a door handle, and said second end of said spindle is insertable into a second opening of a rotatable actuator of a door latch mechanism.

6. A spindle assembly for a door handle assembly, comprising:

a spindle having a first end and a second end; and a spring attached to said first end of said spindle, wherein:

said spring is a coil spring having a proximal end and a distal end, said proximal end of said coil spring having a normal inside diameter that is expandable to a second diameter;

said spindle includes a spindle body and a spindle post axially aligned with said spindle body along an axis, said spindle post having a dimension perpendicularly intersecting said axis, said dimension is greater than said normal inside diameter of said spring; and said spindle post of said spindle is inserted into said proximal end of said coil spring to form a snug fit attachment of said coil spring to said spindle wherein said coil spring and said first end of said spindle of said spindle assembly are insertable as a unit into a first opening of a shank of a door handle, and said second end of said spindle is insertable into a second opening of a rotatable actuator of a door latch mechanism.

7. The spindle assembly of claim 6, further comprising a limiter attached to said spindle body.

8. The spindle assembly of claim 7, wherein said limiter is a C-clip that engages a groove in said spindle body.

* * * * *